United States Patent [19]

Sakakino et al.

[11] 4,301,344

[45] Nov. 17, 1981

[54] ILLUMINATED PUSHBUTTON SWITCH

[75] Inventors: Takahiro Sakakino; Norio Iwakiri, both of Nagaokakyo, Japan

[73] Assignee: Omron Tateisi Electronics Co., Kyoto, Japan

[21] Appl. No.: 96,397

[22] Filed: Nov. 21, 1979

[30] Foreign Application Priority Data

Dec. 9, 1978 [JP] Japan ..... 53-152859

[51] Int. Cl.[3] ..... H01N 9/02; H01H 9/16

[52] U.S. Cl. ..... 200/314; 200/311

[58] Field of Search ..... 200/314, 311

[56] References Cited

U.S. PATENT DOCUMENTS

| | | | |
|---|---|---|---|
| 3,267,245 | 8/1966 | Vincent | 200/314 |
| 3,509,300 | 4/1970 | Hipple | 200/314 |
| 3,517,148 | 6/1970 | Di Pilla | 200/314 |
| 3,522,402 | 8/1970 | Di Pilla | 200/314 |
| 3,731,028 | 5/1973 | Ando | 200/167 A |

*Primary Examiner*—Willis Little

*Attorney, Agent, or Firm*—Wegner & Bretschneider

[57] ABSTRACT

An illuminated pushbutton switch comprising a housing, a switching component, a reset spring, and an illuminator component including a lamp holder and a pushbutton which is removably installed in the housing. Characteristically, this switch further comprises a leaf spring which is secured at its base end to the lamp holder and disposed to provide a predetermined spacing between the lamp holder and pushbutton, and engaging means formed in the pushbutton for engaging a free end of the leaf spring, and a stationary member for transversely biasing the leaf spring out of engagement from said engaging means as the reset spring returns to its original position.

4 Claims, 6 Drawing Figures

ILLUMINATED PUSHBUTTON SWITCH

BRIEF SUMMARY OF THE INVENTION

The present invention relates to an illuminated pushbutton switch provided with lamps wherein when the switch is mounted on an operational panel the lamps are replaceable from the front of the panel, and more particularly to an illuminated pushbutton switch having a safety mechanism by which the lamps may be replaced without causing the switching component installed in the switch to be erroneously operated.

There is well known an illuminated pushbutton switch wherein an illuminator portion, consisting of a pushbutton having an illumination display plate and a lamp holder, is removable from the housing for replacing the lamps, and, after replacement, is remountable into the housing. Such a conventional pushbutton switch, however, has the disadvantage that, upon insertion of the illuminator portion, the switching component installed in a lower portion of the housing is actuated to cause the electric circuit connected to the switch to be erroneously operated. Therefore, an improved pushbutton switch having a safety mechanism for preventing it from being erroneously operated has for some time been desired in the field of certain equipment such as computer system a main power switch of which is difficult to be switched-off simply for the purpose of replacing the lamps.

In order to eliminate the above-mentioned disadvantage, there has been proposed an illiminated pushbutton switch wherein a certain member disposed on the lamp holder must be manually engaged with the pushbutton prior to reinsertion of the illuminator portion into the housing. However, it has the disadvantage that such a manual operation is troublesome and, if the illuminator portion is reinserted into the housing omitting this manual operation, the switching component is actuated. Moreover, the illuminated pushbutton switch so far proposed has a complicated construction and is costly to manufacture.

It is, therefore, a primary object of the present invention to provide an illuminated pushbutton switch with a safety mechanism for preventing the switching component from being actuated undesirably on reinsertion of the illuminator component into the housing but substantially allowing the switching component to function properly as designed.

It is a further object of the present invention to provide an illuminated pushbutton switch with a safety mechanism which dose not require the maintenance personel to perform any additional operation other than a mere replacement of faulty lamps.

It is a still further object of the present invention to provide an illuminated pushbutton switch having a simple and cheap construction.

Other objects as well as the numerous advantages of the illuminated pushbutton switch according to the present invention will become apparent from the following detailed description and accompanying drawings, in which:

DETAILED DESCRIPTION

Figure 1:
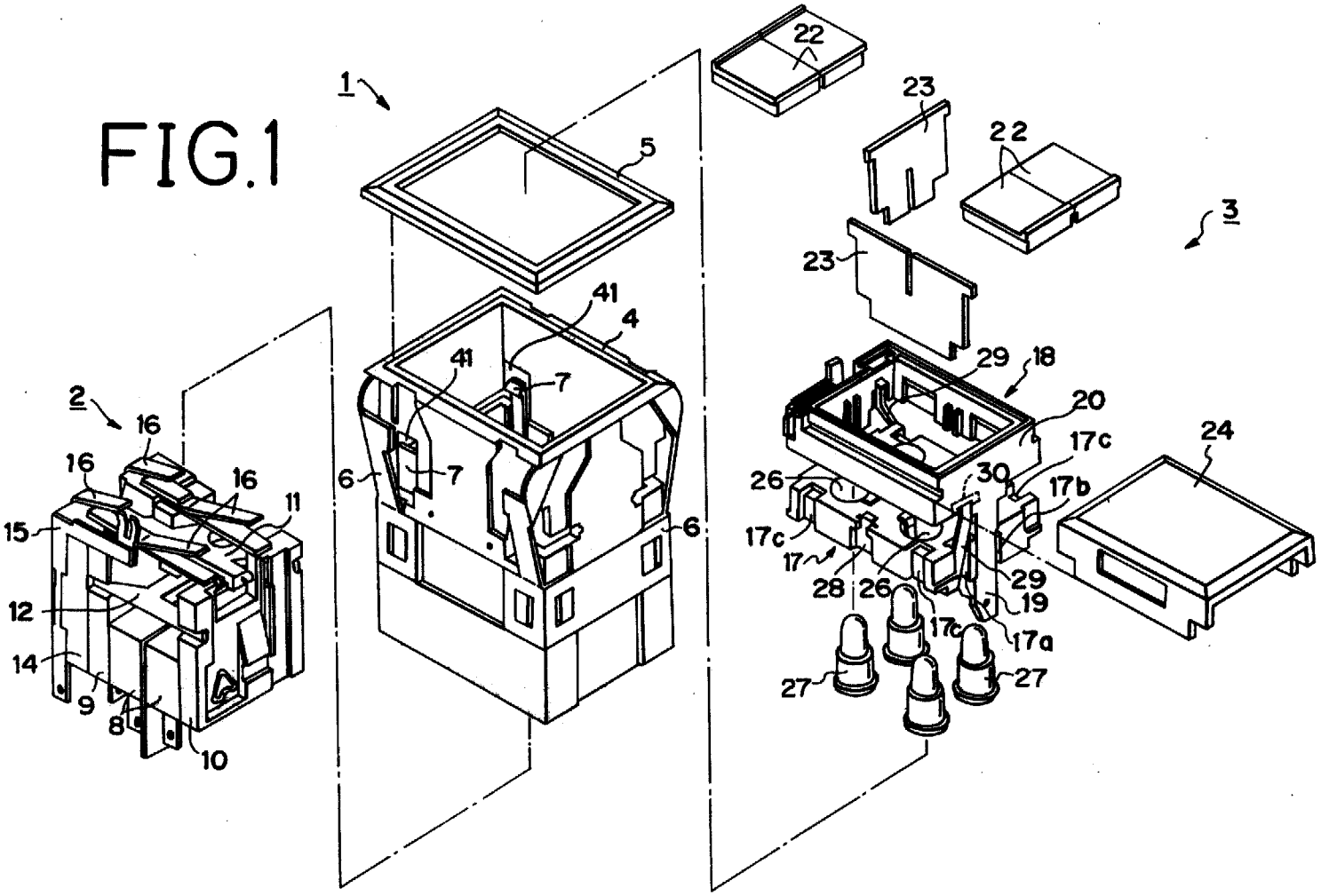
FIG. 1 is a perspective disassembled view showing an illuminated pushbutton switch as one embodiment of the present invention.
Figure 2:
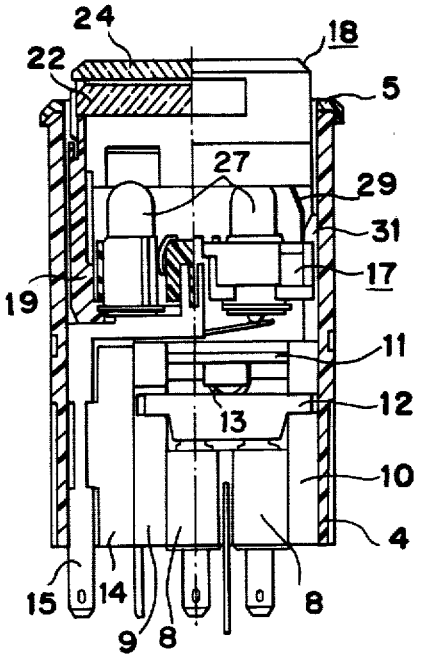
FIG. 2 is a sectional view of the illuminated pushbutton switch assembly of the switch of FIG. 1.

Referring, now, to FIGS. 1 and 2, there is shown an illuminated pushbutton switch comprising a housing 1 having upper and lower openings, a switching component 2 installed in a lower portion of the housing 1, and an illuminator component 3 which is removably mounted on the housing 1 and is supported by the housing 1 at an upper portion thereof.

The housing 1 includes a housing body 4, a decorative frame 5 designed for an improved appearance of the switch, and a pair of leaf springs 6 attached to the outer side walls of the housing body 4 for mounting the body 4 into an operational panel. The housing body 4 is provided with cut-out portions 41 in lateral sides thereof and the corresponding snap-on members 7 as disposed in said cut-out portions 41, said snap-on members 7 being adapted to provide a firm grip on the illuminator component 3 on insertion of the latter into the housing body 4.

The switching component 2 includes a pair of switches 8, a pair of juxtaposed base plates 9 and 10 which secure the switches 8, and a pair of levers 11 and 12 which are pivotally supported by the base plates 9 and 10. A reset spring 13 is disposed between the levers 11 and 12, which is operatively connected with free ends of the levers so as to provide a snap action mechanism. In response to a descent of the lever 11, the lever 12 pivotally moves with a snap action to actuate the switches 8. A terminal stand 14 is juxtaposed with the plate 9, and carriers a common lamp terminal lead 15 and four isolated lamp terminal leads 16 which are adapted to contact lamps as described later.

The illuminator component 3 includes a lamp holder 17 and a pushbutton 18, which is removably installed in the housing body 4. The pushbutton 18 consists of a frame 20, a pair of opposite levers 19 formed as a single unit with the frame 20 which when pushbutton 18 is in an operative position, are adapted to depress the lever 11 of the switching component 2, colored transparent plates 22 mounted on the frame 20, a pair of separation plates 23 for providing optically separated chambers corresponding to the colored plates 22, and a transparent cap 24 mounted on the frame 20, by sliding it transversely along a slit therein, and covering the plates 22.

The lamp holder 17 has a pair of recessed portions 17*b* which are formed on the opposite sides of the holder 17 and are engaged with the levers 19, so that the holder 17 is adapted to slidably hold the pushbutton 18 for relative movement over a predetermined stroke. The holder 17 is provided with four lamp socket holes 26 which accept the lamps 27 from below the holder 17. As the illuminator component 3 has been inserted into the housing body 4 from thereabove, the snap-on members 7 are engaged with recessed portions 17*c* formed on the holder 17 so as to provide a firm grip on the holder 17. At the same time, the above-mentioned common lead 15 comes in contact with a common contact lead 28, and the isolated leads 16 respectively come in contact with the lower contacts of the lamps 27. The holder 17 thus gripped is anchored to the housing body while the pushbutton 18 is supported by the body 4 for slidable movement over a predetermined stroke necessary for actuating the switches 8.

Figure 3:
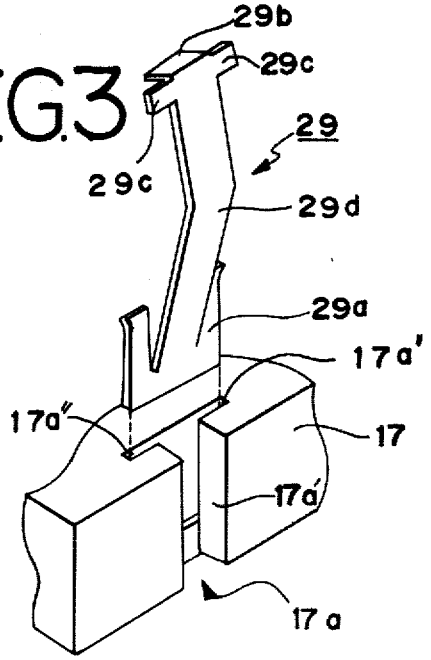
FIG. 3 is a perspective veiw showing a leaf spring before it is secured to a lamp holder which is employed in the switch of FIG. 1.

A pair of leaf spring 29 are secured at base ends thereof to a pair of recessed portions 17*a* formed on opposite sides of the holder 17 so as to provide a predetermined spacing between the pushbutton 18 and holder 17. In FIG. 3 there is shown one of the leaf springs 29 before it is secured to the holder 17. The leaf spring 29 includes a base end 29*a*, a bent tongue 29*b* in the shape of "L", a pair of tongues 29*c*, and a bent portion 29*d*. The recessed portion 17*a* of the lamp holder 17 includes a guide groove 17*a'* and a pair of slits 17*a''*. The base end 29*a* is installed in the slits 17*a''*.

Figure 4:
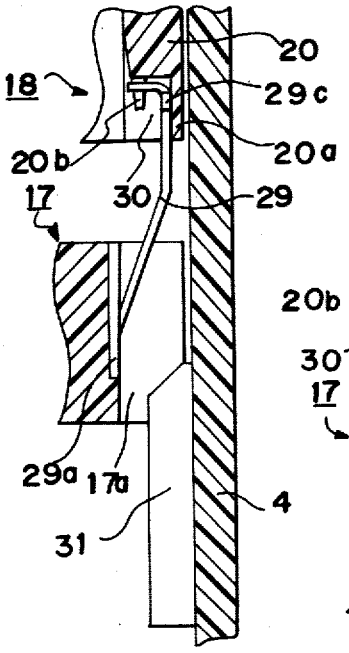
FIGS. 4, 5 and 6 are partially enlarged sectional views for illustrating the movement of the leaf spring in the switch of FIG. 1.

A pair of recessed portions 30 are formed on opposite side walls of the frame 20 so as to engage the free ends 29*b* and 29*c* of the springs 29. As shown in FIG. 4, the recessed portion 30 has a back wall portion 20*a* and a pair of projecting portions 20*b* (only one is shown in FIG. 4), both contiguous to the frame 20.

On inside walls of the housing body 4 there are provided a pair of elongated projections 31 corresponding to the leaf springs 29, respectively. As the illuminator component 3 is inserted in the housing body 4, the projection 31 guides the component 3 by engaging the above-mentioned guide groove 17*a'* of the lamp holder 17 and transversely bias the leaf spring 29 at predetermined position.

Figure 5:
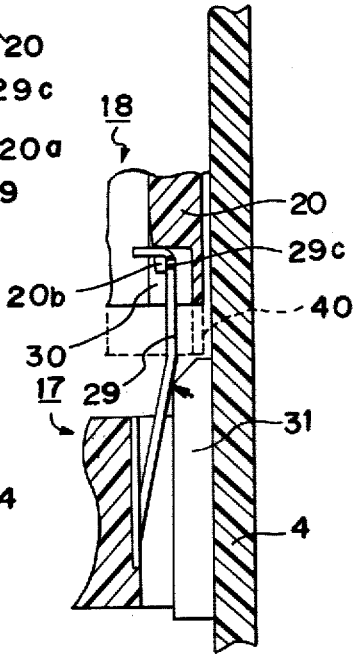
Figure 6:
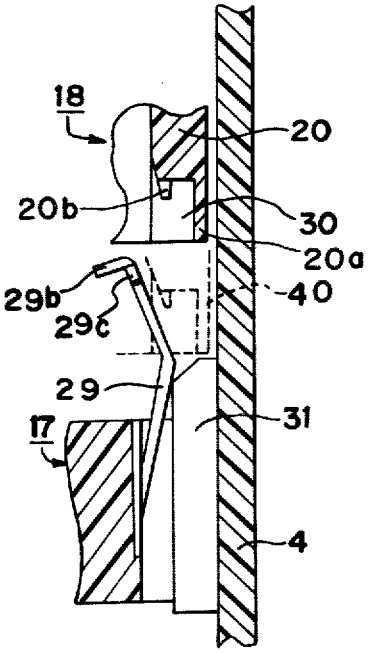

Referring to FIGS. 4, 5 and 6, there is illustrated the movement of the leaf spring 29 in response to insertion of the illuminator component 3 into the housing body 4.

As the illuminator component 3 has been removed from the housing body 4 for changing the lamps 27, the free end portions 29*b* and 29*c* of the spring 29 are enclosed in the recessed portion 30 of the frame 20. In the removed illuminator component 3, faulty lamps may be replaced with wholesome lamps without disassembling the component 3 which has been formed by assembling the lamp holder 17 and pushbutton 18.

After the illuminator component 3 has been reinserted into the housing body 4 from the upper opening thereof as shown in FIG. 4, whereby the pushbutton 18 has been slightly lowered together with the lamp holder 17, a predetermined spacing between the pushbutton 18 and holder 17 is secured by the spring 29. This predetermined spacing is larger than a normal stroke of the pushbutton 18. Subsequently, even if the illuminator component 3 has been depressed into a position shown in FIG. 5 by depressing the pushbutton 18, whereby the lamp holder 17 comes to engage the snap-on members 7, the pushbutton 18 is located in a position slightly lower than its original position in the housing body 4 and does not reach an operative position 40 (shown in dot lines in FIG. 5) wherein the switches 8 are actuated by the levers 19 of the pushbutton 18, so that the switches 8 are not undesirably actuated by insertion of the illuminator component 3. The leaf spring 29 in the position of FIG. 5 is transversely biased by the projection 31 in the direction of an arrow mark shown in FIG. 5 (to the left-hand side of FIG. 6) but cannot move inwardly owing to its tougues 29*c* engaging the projecting portions 20*b*, whereby the spring 29 is preenergized by the projection 31. Upon relief of the external force depressing the pushbutton 18, the pushbutton 18 is moved from the position of FIG. 5 to its original position shown in FIG. 6 by the reset spring 13 of the switching component 2, and the preenergized spring 29 comes out of engagement with the recessed portion 30 to assume the position shown in FIG. 6.

Thereafter, depressing the pushbutton 18 causes it to descend and assume the operative position 40 (shown in dot lines) without contacting the spring 29. Then, as the illuminator component 3 is again removed from the housing body 4, the spring 29 returns to the position shown in FIG. 4 in response to its annihilation force, whereby the spring 29 is again brought into engagement with the recessed portion 30.

According to the present embodiment, there is provided a safety mechanism which dose not require the maintenance personnel to perform any additional operation other than a mere replacement of faulty lamps, viz. simply removing the illuminator component from the housing body and inserting it therein after a lamp change, whereby the replacement may be performed without causing the installed switching component to be erroneously actuated.

Though in the present embodiment the leaf spring 29 is secured to the lamp holder 17, the spring 29 may be alternatively secured at its base end to the pushbutton 18 while the free end of the spring 29 is adapted to engage the holder 17.

The projection 31 formed in an inner wall of the housing body 4 serves as a guide member which guides the illuminator component 3 in the insertion thereof into the housing body 4. Alternatively, the projection 31 may be replaced with a certain stationary member formed in the switching component 2. As a more simplified construction of the safety mechanism in accordance with the present invention, the projection 31 may be omitted, although the spring 29 must be so disposed as to be transversely biased by an inner wall of the housing body 4 upon insertion of the illuminator component 3. Alternatively, the leaf spring 29 may be disposed in the illuminator component so as to be biased outwardly by a certain stationary member when the illuminator component is inserted into the housing.

It will be understood from the foregoing description that the illuminated pushbutton switch according to the present invention has a safety mechanism which is of a simple construction and which provides for an easy replacement of faulty lamps.

It should be understood that the above description is merely illustrative of the present invention and that many changes and modifications may be made by those skilled in the art without departing from the scope of the appended claims.

What is claimed:

1. In an illuminated pushbutton switch comprising a housing, a switching component installed in a lower portion of the housing and having a reset spring, and an illuminator component having a lamp holder and a pushbutton which is removably installed in the housing, said pushbutton being vertically slidable within said lamp holder for relative movement over a predetermined stroke and having a lever for actuating the switching component, the improvement comprising a leaf spring secured at its base end to one of said lamp holder and pushbutton and disposed in a direction substantially parallel with said predetermined stroke, an engaging means formed in the other one of said lamp holder and pushbutton for engaging with a free end of said leaf spring, and a stationary member for transversely biasing said leaf spring out of engagement with said engaging means as said reset spring returns to its original position after said pushbutton is installed in said housing, wherein the length of said leaf spring is selected so as to prevent the motion of said pushbutton into a position which actuates said switching component while said pushbutton is being installed in the housing.

2. An illuminated pushbutton switch according to claim 1, wherein said leaf spring is secured at its base to said lamp holder and said engaging means is a recessed portion of said pushbutton.

3. An illuminated pushbutton switch according to claim 1, wherein said stationary means is a projection formed on an inside wall of said housing.

4. An illuminated pushbutton switch according to claim 1, wherein a plurality of said leaf spring, engaging means and stationary means are provided in corresponding positions.

* * * * *